United States Patent [19]

Gibson et al.

[11] 4,082,390

[45] Apr. 4, 1978

[54] CONVERTIBLE TRAY CABINET

[75] Inventors: David L. Gibson, Newark, N.Y.; Lawrence J. Barrett, Glenside, Pa.; Patricia A. Moore, New York, N.Y.; David R. Butler, Westport, Conn.

[73] Assignee: C. H. Stuart Inc., Newark, N.Y.

[21] Appl. No.: 753,285

[22] Filed: Dec. 22, 1976

[51] Int. Cl.[2] ..... B65D 25/12

[52] U.S. Cl. ..... 312/284; 206/503; 312/DIG. 33; 312/244

[58] Field of Search ..... 217/26.5; 220/9 F; 224/48 R; 206/503, 508, 523, 111; 312/240, 244, 284, 201, 138 R, 138 A, DIG. 33

[56] References Cited

U.S. PATENT DOCUMENTS

| | | | |
|---|---|---|---|
| 1,893,527 | 1/1933 | Shriver | 312/DIG. 33 |
| 2,939,603 | 6/1960 | Young | 206/508 |
| 3,777,882 | 12/1973 | McIntyre | 206/523 |
| 3,909,089 | 9/1975 | Springer | 312/138 A |
| 3,981,401 | 9/1976 | Blanchard | 206/508 |

*Primary Examiner*—Casmir A. Nunberg
*Attorney, Agent, or Firm*—Schovee & Boston

[57] ABSTRACT

A convertible tray cabinet that can be used as a salesman's case having a base and a lid for carrying a nested stack of jewelry trays, and which cabinet can then be converted to a jewelry case with sliding trays therein by removing the lid, discarding the base, placing the lid on its side and sliding said trays into said lid on a plurality of spaced-apart ribs on the inside surfaces of opposed sidewalls of said lid. The ribs are vertical when the lid is used as a salesman's case and are horizontal when the lid is placed on its side and used as a jewelry case.

31 Claims, 6 Drawing Figures

CONVERTIBLE TRAY CABINET

BACKGROUND OF THE INVENTION

1. Field of the Invention

This invention relates to jewelry tray cabinets and in the preferred embodiment to such a cabinet that can be used as a salesman's case and then converted to a jewelry case for home use.

2. Description of the Prior Art

It is known to use stackable and nestable identical trays for jewelry having integral bottom and side walls with a layer of foam on both the top and bottom surfaces of the bottom wall, such as is disclosed in U.S. Pat. No. 3,804,239 (assigned to the same assignee as is the present application). Further, cabinets having slidable trays therein are generally known. However, applicants know of no cabinets which can be used as a salesman's case accommodating stacked, nested trays and which can then be converted to a jewelry case for home use in which the trays can slide into and out of the cabinet.

It is an object of the present invention to provide such a convertible tray cabinet.

SUMMARY OF THE INVENTION

A convertible tray cabinet that can be used as a salesman's case including a lid releasably connected to a base and enclosing a tray compartment therein holding a plurality of trays stacked and nested one on top of the other. This salesman's case is converted to a jewelry case by providing two opposed long sidewalls of the lid with vertical ribs on the inside surface thereof, whereby the lid can be placed on its side on a short sidewall thereof, making the ribs horizontal and the trays are adapted to slide into the lid on the ribs. The base is discarded in this second use of the lid. The base can include a separate cover and can hold additional articles therein beneath the stacked trays when used as a salesman's case. A plurality of the salesman's cases can be stacked vertically on top of each other and nested because the bottom surface of the base includes a recess to accommodate the handle of the lid of the case stacked immediately beneath it.

BRIEF DESCRIPTION OF THE DRAWINGS

The present invention will be more fully understood by reference to the following detailed description thereof, when read in conjunction with the attached drawings, wherein like reference numerals refer to like elements and wherein.

DETAILED DESCRIPTION OF THE PREFERRED EMBODIMENT

Figure 1:
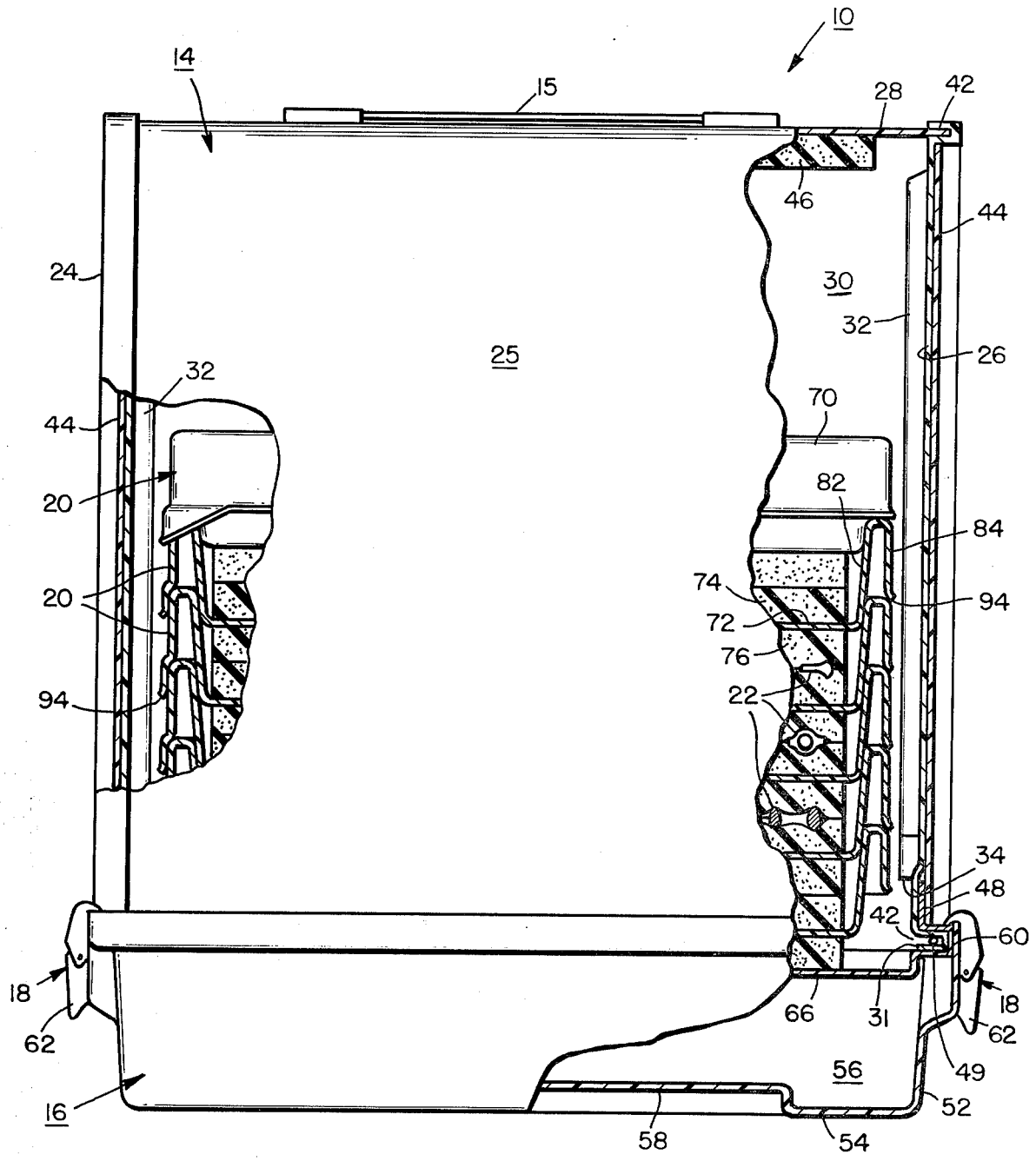
FIG. 1 is a side elevation view, partly broken away, of the convertible tray cabinet of this invention used as a salesman's carrying case.
Figure 2:
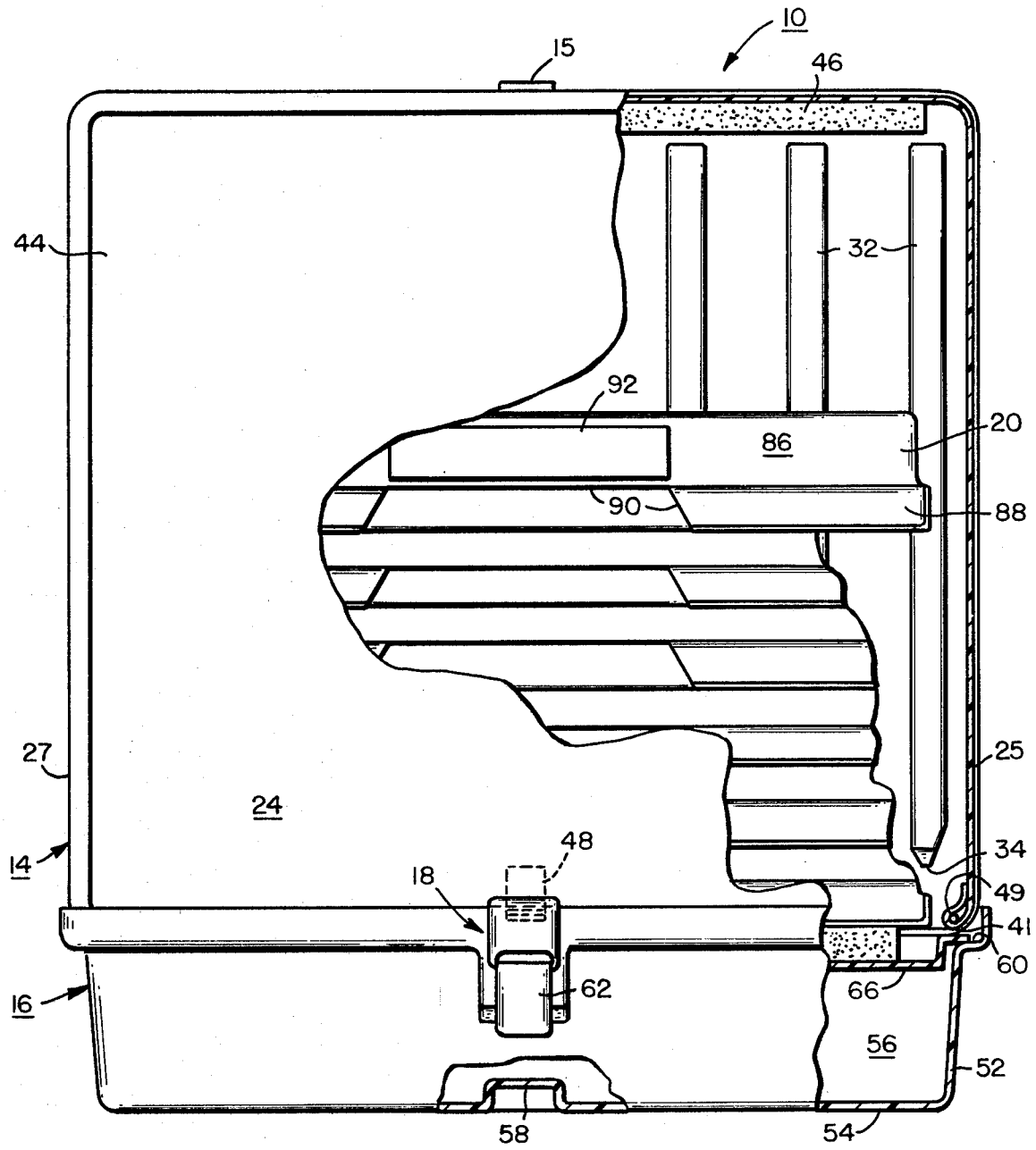
FIG. 2 is a front elevation view, partly broken away, of the case of FIG. 1.
Figure 3:
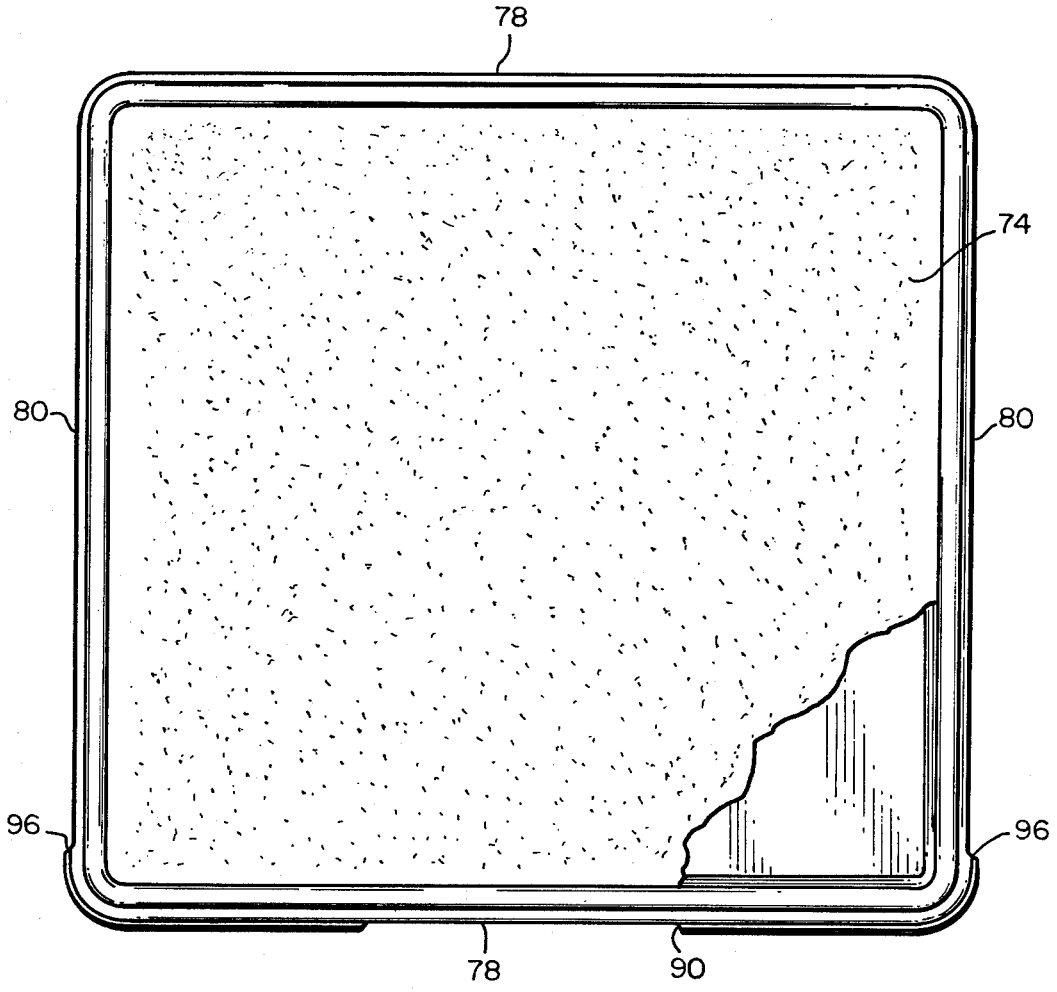
FIG. 3 is a plan view of a tray.
Figure 4:
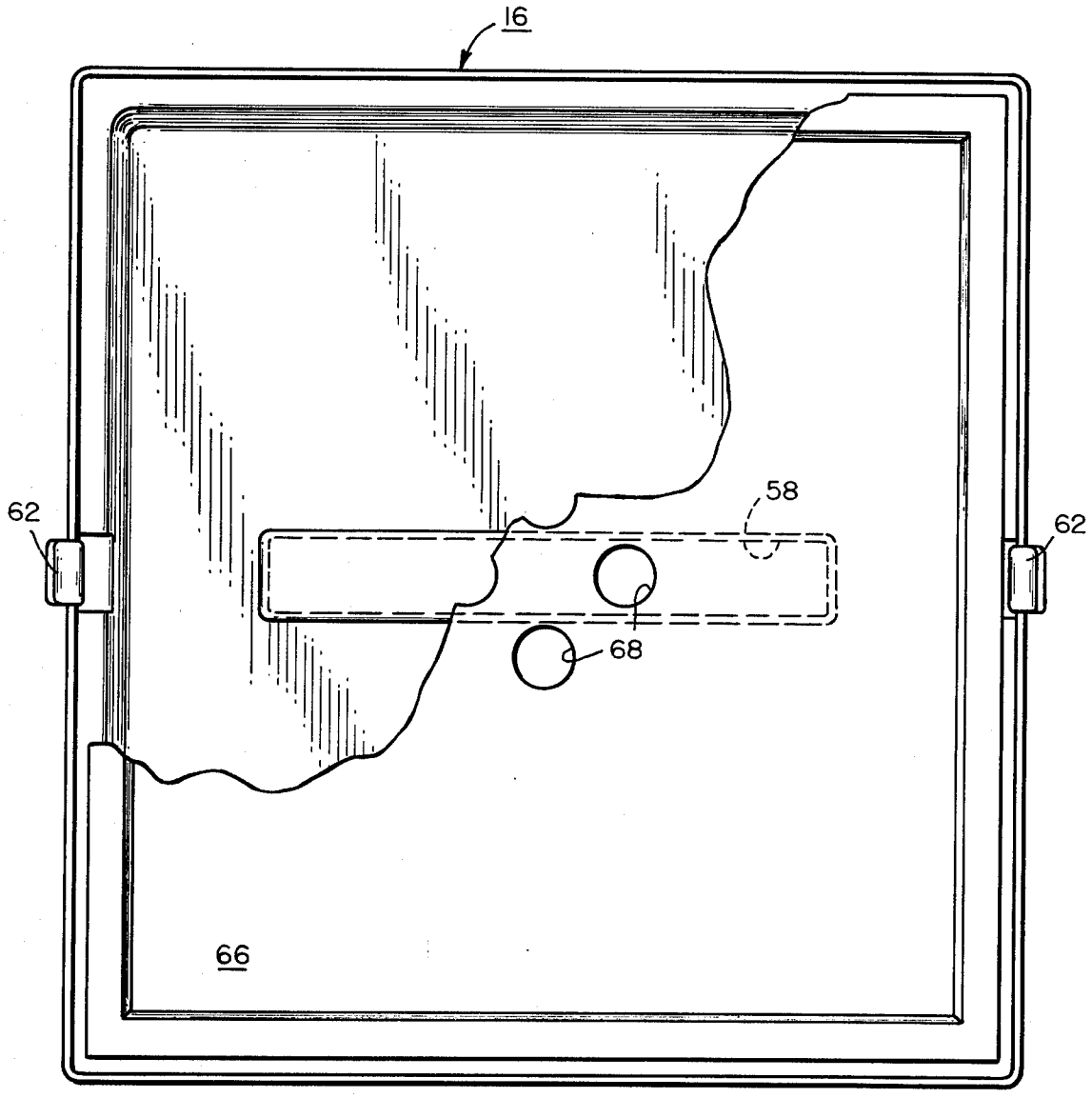
FIG. 4 is a plan view of the base with the cover partly broken away.
Figure 5:
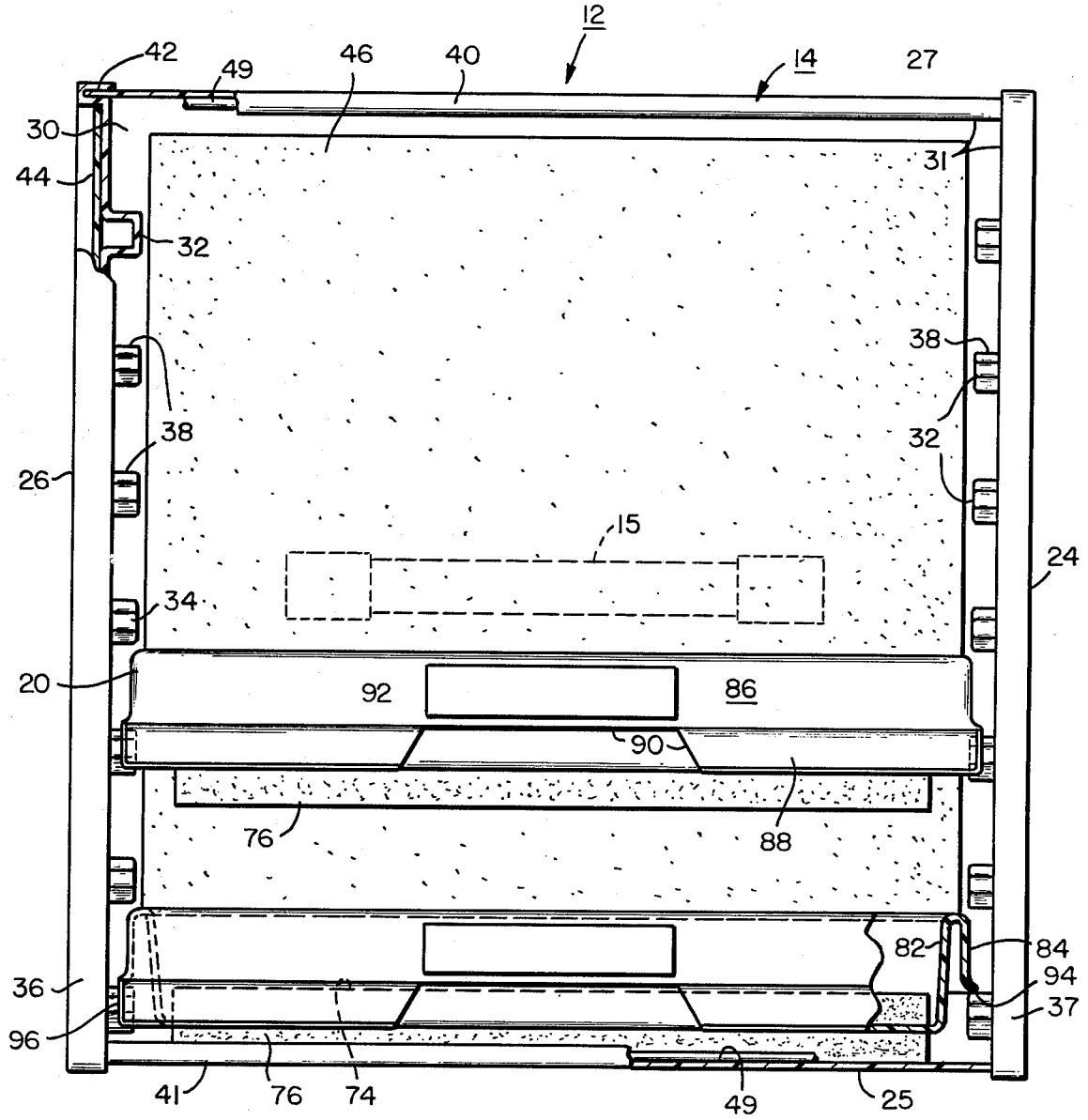
FIG. 5 is a front elevation view, partly broken away, of the cabinet of this invention used as a jewelry case for home use.
Figure 6:
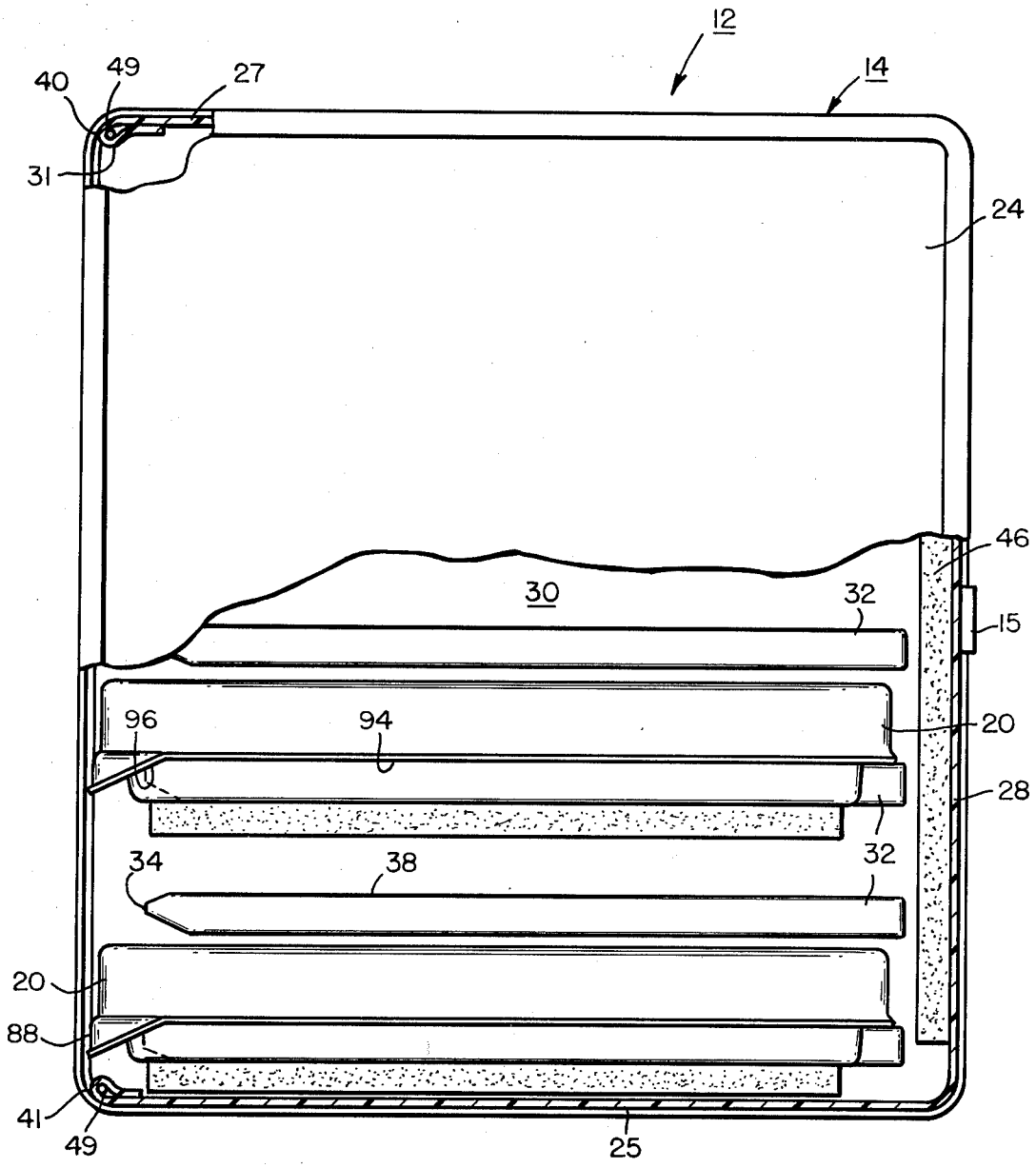
FIG. 6 is a partly broken away side elevation view of the case of FIG. 5.

With reference now to the drawings, FIGS. 1-6 show the convertible tray cabinet of the present invention which can be used as a salesman's case 10 (see particularly FIGS. 1 and 2) or alternatively as a jewelry case 12 (see FIGS. 5 and 6).

With reference first to FIGS. 1–4, the salesman's case 10 includes a lid 14 having a handle 15, a base 16, a pair of latch means 18 for releasably connecting the lid to the base, and a plurality of identical, trays 20 stacked and nested on top of each other inside the case 10. In a preferred use, the trays 20 each hold items of jewelry 22 and the base 16 can hold additional jewelry or any desired articles, such as literature, sales slips, etc.

The lid 14 includes four sidewalls 24, 25, 26, and 27 and a top wall 28 all defining a tray compartment 30 having a bottom opening 31 thereinto. The lid 14 includes a plurality of parallel, vertical, equally spaced-apart ribs 32 on the inside surface of opposed sidewalls 24 and 26. The ribs 32 have an end 34 spaced a predetermined distance inside of the bottom edges 36 and 37 of the sidewalls 24 and 26. The ribs 32 have a sliding surface 38 on which the trays 20 can slide as described below with reference to FIGS. 5 and 6 showing the lid 14 placed on its side for use as a jewlery case for home use. In a preferred embodiment the lid construction comprises the topwall 28 and the two sidewalls 25 and 27 being formed of one piece of fiberboard with the bottom edges 40 and 41 being rolled over and back up along the inside surface of the sidewalls 25 and 27 and attached thereto, such as by suitable adhesive (see FIGS. 2 and 6). The other two sidewalls 24 and 26 are vacuum-formed of suitable plastic with the edges providing a groove 42 into which the fiberboard top and sidewalls are received and glued, for example. A decorative insert 44 is preferably glued on the outside surface of each of the two vacuum-formed sidewalls 24 and 26. The insert 44 can be made removable or permanent, as desired. A layer 46 of foam rubber is glued to the inside surface of the topwall 28 for contacting the uppermost tray 20 and holding the articles securely thereon. A latch slip 48 is attached to each of the sidewalls 24 and 26 adjacent the bottom edge thereof for mating engagement with the remainder of the latch means 18 mounted on the base 16. A metal wire 49, in the approximate form of a square, can be provided around the bottom edge of the lid 14 inside of the rolled edges 40 and 41 and the groove 42 to provide strength and rigidity to the bottom opening 31.

The base 16 includes a sidewall 52 and a bottom wall 54 enclosing a compartment 56 for salesman's literature, etc. A recess 58 is provided in the bottom surface of the bottom wall 54 of a size, shape, and orientation to receive and accommodate the handle 15 so that a plurality of the cases 10 can be stacked on top of each other and nested together. The sidewall 52 is formed to provide a shoulder 60 for supporting the lid 14. The front and rear portions of the sidewall 52 are each provided with a latch 62 mounted on a raised surface thereof for mating engagement with one of the latch clips 48 on the lid 14. The sidewall 52 can be made of any desired height to provide the compartment 56 with the desired size.

The base 10 is preferably provided with a cover 66 adapted to be supported on the shoulder 60. The cover can have a plurality of finger holes 68 therein to allow it to be grasped and removed. The trays 20 can be supported directly on the cover, or on a shoulder of the base, or on the bottom of the base, as described.

The trays 20 are preferably all identical and thus only a single one need be described. The tray 20 includes a one-piece plastic member 70 having a continuous sidewall and an integral bottom wall 72 having an upper layer 74 of foam and a lower layer 76 of foam. The tray 20 includes a pair of opposed long sidewalls 78 and a pair of opposed short sidewalls 80. The sidewalls include an inner sloping wall 82 and an outer skirt 84, designed to allow the trays to be stacked on top of each other in a nesting manner so that any articles 22 are held securely between two contacting layers of foam rubber (or other suitable material). One of the long sides is the front side 86 and has a longer skirt 88 with a cut-out portion 90 centrally located therein, so that an identification label 92 or a decorative strip can be applied to the central outside surface of the front skirt 88 and be visible without the front skirt of the tray immediately thereabove covering it up. The outside dimensions of the tray 20 are such that it fits within the lid 14 with only a little room to spare so that shifting and movement of the trays 20 during shipment is minimized; the contact between the adjacent skirts of the trays above and below each tray aids to minimize lateral movement of the trays. Additional details of the tray 20, particularly of the skirt thereof will be described below in reference to the use of the convertible tray cabinet as a jewelry case 12.

In operation, the salesman's case 10 contains a plurality of trays 20 of jewelry 22 (or other items) conveniently located in separate trays, as well as other items in the base 16. To show a particular item it is only necessary to unlatch the lid 14 and lift off that tray immediately above the desired tray, exposing the items to be shown. The handle 15 is oriented so that the latch means 18 do not hit the clothing of the person carrying the case 10.

The use of the convertible tray cabinet as a jewelry case 12 will now be described with reference to FIGS. 5 and 6. To convert the salesman's case 10 to a jewelry case 12, the lid 14 is removed and placed on its side with the short sidewall 25 being the bottom wall of the jewelry case 12. The opening 31 is now the front of the jewelry case 12. The ribs 32 that were vertical in the salesman's case 10 are now horizontal. The trays 20 can be slid into the compartment 30 onto the ribs 32. In the embodiment shown in the drawings, 10 trays can be stacked on top of each other in the case 10 while there is room for only seven trays to slide into the lid when used as a jewelry case.

The ribs 32 are equally spaced-apart a distance to provide room for the trays to be individually moved into and out of the compartment 30 without interference from adjacent trays. The trays 20 include bottom side edges 94 of the skirt 84 on the two short sides of the tray for sliding on top of the ribs 32. The bottom edges 94 are spaced outwardly away from the inner walls 82. The skirt 84 includes an outwardly and downwardly extending stop 94 adjacent the front of the side edges 94 for contacting the front end 34 of the ribs 32 to define the innermost extent of movement of the trays 20 into the compartment 30, whereby all of the trays will be located at the same position in the lid 14.

It is noted that the trays 20 are not square, but that the long sides 78 are somewhat (for example ¼ inch) longer that the short sides 80 and that the trays 20 are turned 90° about a vertical axis from their position in the salesman's case 10 to their orientation in the jewelry case 12. The lid 14 also has a pair of opposed long walls 24 and 26 and a pair of opposed short walls 25 and 27. The trays 20 when stacked in the lid 14 in FIGS. 1 and 2 for use as a salesman's case 10 are oriented with their long sides adjacent the long sides of the lid. However, in the jewelry case 12, the short sides of the tray 20 are adjacent the long sides of the lid 14. The tray length is greater than the tray width, the tray width is less than the lid 14 heighth, the tray length is less than the inside length of the lid 14, the tray width is less than the inside width of the lid 14, and the tray length is greater than the width between the ribs 32 (so as to overlap and ride on top of the ribs) but is less than the inside wall-to-wall width of the lid 14.

The invention has been described in detail with particular reference to the preferred embodiments thereof, but it will be understood that variations and modifications can be effected within the spirit and scope of the invention as described hereinabove and as defined in the appended claims. For example, it is noted that it is not essential that the base 16 have its own separate compartment. The trays 20 do not have to be able to nest one inside the other in the salesman's case 10. The salesman's case 10 can have any desired type of latch means. The jewelry case 12 can be provided with a front cover is desired, and the base or the cover 66 can be used or modified for use as such a cover. The handle 15 can be recessed into the top wall 28 of the lid 14 for stacking and nesting of a plurality of cases 10 instead of having the handle project above the surface with a corresponding groove in the bottom wall of the base 16. Other numbers of trays can be used in place of 10 and 7 as described above for use in the salesman's case and the jewelry case respectively. The salesman's case and the jewelry case can be used for holding a wide variety of different types of objects; the present invention is not limited to use with jewelry. The synthetic rubber foam layers 72 and 74 can have a smooth flat surface or can be sculptured to fit various items to be carried, if desired, and can be made of other material other than synthetic foam rubber. While the lid 14 has a "vertical" orientation when used as a salesman's case 10 and a "horizontal" orientation when used as a jewelry case, these terms are only relative and this invention is not limited to exact vertical or horizontal orientations of the lid or of the ribs.

What is claimed is:

1. A convertible tray cabinet comprising:

(a) a lid including four sidewalls and a top wall and enclosing a tray compartment inside of said lid, (b) a base including four sidewalls, a bottom wall, and means for supporting said lid thereon, (c) means for releasably connecting said lid to said base, (d) a plurality of trays stacked on top of each other in said tray compartment with each tray being in a horizontal orientation, (e) said lid including a plurality of spaced-apart, vertical ribs extending inwardly from the inside surfaces of two opposite sidewalls, and (f) each tray including means for slidably supporting the tray on a pair of opposed ones of said ribs when said lid is placed on its side by being moved from a vertical orientation to a horizontal orientation and is supported on one of the sidewalls in-between said opposite sidewalls whereby said ribs are horizontally oriented.

2. The cabinet according to claim 1 wherein said lid includes a pair of opposed long sides and a pair of opposed short sides and wherein said ribs are located on said long sides.

3. The cabinet according to claim 2 wherein each tray has a pair of opposed long sides and a pair of opposed short sides and said trays being stacked within said tray compartment of said lid with the long sides of the trays adjacent the long sides of the lid and the short sides of the trays adjacent the short sides of the lid, with a small space between the tray and the lid walls to hold the tray securely and minimize any movement and shifting of the trays within said cabinet.

4. The cabinet according to claim 1 wherein the tray has a pair of opposed long sides and a pair of opposed short sides and the length of the tray is greater than the inside dimension between opposed ribs of the lid, but is less than the inside dimensions of both the length and width of said lid.

5. The cabinet according to claim 1 wherein said trays are all identical and are nestable one inside the other.

6. The cabinet according to claim 5 wherein each of said trays includes four sidewalls, a bottom wall and a layer of foam secured to both the top and bottom surfaces of the bottom wall of a thickness sufficient to contact adjacent foam layers of adjacent trays when the trays are stacked and nested one on top of the other.

7. The cabinet according to claim 1 wherein said base has a height sufficient to provide a storage compartment therein beneath the lowermost tray stacked in said lid.

8. The cabinet according to claim 7 including a separate cover for said base, and means for supporting said cover on said base and spaced above the bottom wall of said base.

9. The cabinet according to claim 8 wherein said stacked trays are supported on said cover.

10. The cabinet according to claim 1 wherein said two opposite sidewalls are vacuum molded of plastic and including decorative inserts covering the outside surface thereof.

11. A convertible tray cabinet comprising:

(a) a lid including four sidewalls and a top wall and enclosing a tray compartment inside of said lid,
(b) a base including four sidewalls, a bottom wall, and means for supporting said lid thereon,
(c) means for releasably connecting said lid to said base,
(d) a plurality of trays stacked on top of each other in said tray compartment with each tray being in a horizontal orientation,
(e) said lid including a plurality of spaced-apart, vertical ribs extending inwardly from the inside surfaces of two opposite sidewalls, said two opposite sidewalls being vacuum molded of plastic and including decorative inserts covering the outside surface thereof,
(f) each tray including means for slidably supporting the tray on a pair of opposed ones of said ribs when said lid is placed on its side by being moved from a vertical orientation to a horizontal orientation and is supported on one of the sidewalls in-between said opposite sidewalls whereby said ribs are horizontally oriented, and
(g) said topwall and the other two opposing sidewalls being formed as one integral piece of fiberboard, said plastic sidewalls having an elongated, inwardly opening slot at their peripheral edge, and said fiberboard walls being inserted into said slots for connecting said walls together.

12. The cabinet according to claim 11 wherein the bottom edge of each of said fiberboard sidewalls is rolled over inwardly and upwardly and glued to the inside wall thereof to form smooth curved edges along the bottom sidewalls.

13. The cabinet according to claim 1 including a handle located on the top surface of said topwall of said lid and including a recess in the bottom surface of the bottom wall of said base of a size and orientation to receive and accommodate said handle whereby a plurality of said cabinets can be stacked and nested one on top of the other.

14. A convertible tray cabinet comprising:

(a) a lid including four sidewalls and a top wall and enclosing a tray compartment inside of said lid,
(b) a base including four sidewalls, a bottom wall, and means for supporting said lid thereon,
(c) means for releasably connecting said lid to said base,
(d) a plurality of trays stacked on top of each other in said tray compartment with each tray being in a horizontal orientation,
(e) said lid including a plurality of spaced-apart, vertical ribs extending inwardly from the inside surfaces of two opposite sidewalls,
(f) each tray including means for slidably supporting the tray on a pair of opposed ones of said ribs when said lid is placed on its side by being moved from a vertical orientation to a horizontal orientation and is supported on one of the sidewalls in-between said opposite sidewalls whereby said ribs are horizontally oriented, and wherein said slidably supporting means includes an elongated edge on opposed sides thereof for sliding on top of said ribs when said lid is placed on its side, and including a stop on said elongated edge adjacent the front of said tray for contacting a front end of said ribs to define the rearmost sliding position of said trays into said tray cabinet.

15. A convertible tray cabinet comprising:

(a) a lid including four sidewalls and a top wall and enclosing a tray compartment inside of said lid,
(b) a base including four sidewalls, a bottom wall, and means for supporting said lid thereon,
(c) means for releasably connecting said lid to said base,
(d) a plurality of trays stacked on top of each other in said tray compartment with each tray being in a horizontal orientation,
(e) said lid including a plurality of spaced-apart, vertical ribs extending inwardly from the inside surfaces of two opposite sidewalls,
(f) each tray including means for slidably supporting the tray on a pair of opposed ones of said ribs when said lid is placed on its side by being moved from a vertical orientation to a horizontal orientation and is supported on one of the sidewalls in-between said opposite sidewalls whereby said ribs are horizontally oriented, and wherein said trays each have a pair of opposed long sides and a pair of opposed short sides and a sidewall including an inner wall and an outer downwardly depending skirt having a straight lower edge on the two short sides, said lower edge being spaced outwardly from said inner wall, and wherein said slidably supporting means comprises said lower edge on the two opposed short sides.

16. The cabinet according to claim 15 wherein said skirt tapers downwardly and outwardly and is adapted to overlap and receive therewithin the top edge of the walls of the tray nested immediately therebelow, for minimizing lateral shifting of said trays with respect to each other.

17. The cabinet according to claim 1 wherein said ribs are all identical and equally spaced-apart.

18. The cabinet according to claim 17 wherein the front end of said ribs is positioned a predetermined distance inwardly from the bottom edge of said sidewalls.

19. The cabinet according to claim 1 wherein each of said trays includes an inner wall and an outer downwardly depending skirt having a cut-out centrally located therein for allowing the inner wall to be visible from the front of the tray.

20. A lid for a convertible tray cabinet comprising two longer opposite sidewalls and two shorter opposite sidewalls and a top wall and a plurality of identical, spaced-apart vertical ribs on the inside surfaces of said longer sidewalls.

21. A method for carrying and storing a plurality of trays in a cabinet comprising stacking said trays on top of each other on a base, placing a lid having a pair of opposing long sides and a pair of opposing short sides over said trays and connecting it to said base for carrying said trays, providing said lid with a plurality of spaced-apart, vertical ribs on the inside surface of the opposing long sidewalls thereof, removing said lid from said base and placing it on its side on a short sidewall thereof such that said vertical ribs become horizontal, and sliding said trays into said lid on said ribs.

22. The method according to claim 21 including providing a stop on said trays for contacting a front end of said ribs and sliding said tray into said lid until said stop contacts said rib.

23. The method according to claim 21 including storing articles in a storage compartment in said base between a bottom wall of said base and a lowermost one of said trays.

24. The method according to claim 21 including providing a handle on top of said lid and providing a recess in a bottom surface of a bottom wall of said base of a size and orientation so as to accommodate and receive said handle on said lid, and stacking and nesting a plurality of said cabinets on top of each other with the handles accommodated in said recesses.

25. A method for converting a salesman's case having a base, a lid and a plurality of jewelry trays stacked thereinside, into a jewelry case with sliding trays, comprising: forming each of said lid and trays with a pair of opposing long sides and a pair of opposing short sides, stacking said trays on top of each other with the long sides of the trays adjacent the long sides of the lid, providing a plurality of parallel spaced-apart vertical ribs on the inside surface of the long sides of said lid, placing said lid on its side with a short side down, and sliding said trays into said lid with the short sides of the trays adjacent the long sides of the lid and in sliding support on said ribs.

26. The method according to claim 25 including providing said long sides of said trays with a length greater than the inside dimension between opposed ribs but less than the inside dimension of both the length and width of the lid.

27. The lid according to claim 20 wherein said ribs are equally spaced-apart, extend inwardly away from said inside surfaces of said longer sidewalls, and are horizontal when said lid is placed on its side with one of said sidewalls on a horizontal surface.

28. The lid according to claim 27 wherein, when said lid is so placed on its side, each of said ribs has a smooth, flat, top surface for slidably receiving a tray thereon, and wherein opposed pairs of ribs are at substantially identical heights.

29. A convertible tray cabinet comprising:

(a) a lid including four sidewalls enclosing a tray compartment inside of said lid, (b) a plurality of trays stacked horizontally on top of each other in said tray compartment, (c) means for releasably supporting said trays in said tray compartment, (d) said lid including a plurality of spaced-apart, vertical ribs extending inwardly from the inside surfaces of two opposite sidewalls, and (e) each tray including means for slidably supporting the tray on a pair of opposed ones of said ribs when said lid is placed on its side by being moved from a vertical orientation to a horizontal orientation and is supported on one of the sidewalls in-between said opposite sidewalls whereby said ribs are horizontally oriented.

30. The cabinet according to claim 29 wherein said lid includes a pair of opposed long sides and a pair of opposed short sides and wherein said ribs are located on said long sides.

31. The cabinet according to claim 30 wherein each tray has a pair of opposed long sides and a pair of opposed short sides and said trays being stacked within said tray compartment of said lid with the long sides of the trays adjacent the long sides of the lid and the short sides of the trays adjacent the short sides of the lid, with a small space between the tray and the lid walls to hold the tray securely and minimize any movement and shifting of the trays within said cabinet, and wherein the length of the tray is greater than the inside dimension between opposed ribs of the lid, but is less than the inside dimensions of both the length and width of said lid.

* * * * *